United States Patent [19]
Nakajima et al.
[11] 4,277,524
[45] Jul. 7, 1981

[54] METHOD AND APPARATUS FOR FINISHING COATED PAPERS

[75] Inventors: Hideiku Nakajima; Itsuji Koyama; You Kusama; Yutaka Ashie, all of Tokyo, Japan

[73] Assignee: Mitsubishi Paper Mills, Ltd., Tokyo, Japan

[21] Appl. No.: 106,387

[22] Filed: Dec. 26, 1979

[30] Foreign Application Priority Data

Dec. 27, 1978 [JP] Japan ..... 53-162354

[51] Int. Cl.[3] ..... B05D 3/00; B05D 3/02; B05D 3/12; B05C 11/02

[52] U.S. Cl. ..... 427/362; 118/60; 118/66; 118/67; 118/69; 118/101; 118/115; 118/117; 427/366; 427/374.3; 427/391; 427/398.1

[58] Field of Search ..... 118/60, 69, 67, 66, 118/101, 115, 117; 427/361, 362, 366, 374 A, 374 B, 398 R, 374.2, 374.3, 398.1, 391

[56] References Cited

U.S. PATENT DOCUMENTS

| | | | |
|---|---|---|---|
| 3,330,688 | 7/1967 | Halsey et al. | 427/362 |
| 3,583,881 | 6/1971 | Kennedy | 427/362 |
| 3,873,345 | 3/1975 | Vreeland | 427/361 |
| 3,982,056 | 9/1976 | Holder | 427/362 |
| 4,041,197 | 8/1977 | Gagne | 427/362 X |
| 4,048,380 | 9/1977 | Blakey et al. | 428/511 |

*Primary Examiner*—Michael R. Lusignan

[57] ABSTRACT

An aqueous coating composition containing thermoplastic synthetic resin emulsion is applied to a paper web to form a coating layer and dried at a temperature to maintain the coating layer below the glass transition temperature of the thermoplastic synthetic resin emulsion. The coated paper web is passed on a finishing roll having a mirror-like metal surface heated to a temperature above the glass transition temperature of the emulsion. The surface of the coating layer of the coated paper web is brought into pressing contact with the finishing roll and heated to a temperature above the glass transition temperature of the emulsion, while the coated paper web is passed on the finishing roll. The coated paper web is cooled until the temperature of the surface of the coating layer is reduced to a level not exceeding the glass transition temperature of the emulsion by 30° C., and passed over the finishing roll again after the cooling step is followed, whereby the coated surface of the coated paper web is finished to have super-high-gloss and high smoothness.

16 Claims, 7 Drawing Figures

METHOD AND APPARATUS FOR FINISHING COATED PAPERS

BACKGROUND OF THE INVENTION

1. Field of the Invention

This invention relates to a method of and apparatus for finishing coated papers enabling smooth, super-high-gloss coated papers to be produced.

2. Description of the Prior Art

Various methods have hitherto been available for finishing coated papers to impart high or improved smoothness and gloss thereto. In one method well known in the art as a gloss calendering method, an aqueous coating composition containing thermoplastic synthetic resin emulsion is applied to the surface of a paper web to form a coating layer or film and the coated paper web is subjected to finishing in two stages after the coated composition is dried at a temperature below the glass transition temperature of the thermoplastic synthetic resin emulsion, the finishing stages including a fir st finishing stage in which the coated paper web is passed over a finishing roll while the surface of the coating layer is brought into pressing contact with a mirror-like metal surface of the finishing roll heated to a temperature above the glass transition temperature of the emulsion, and a second finishing stage in which the coated paper web is passed over the finishing roll while the surface of the coating layer is brought into pressing contact with the finishing roll. The gloss calendering method described hereinabove has the advantages that coated papers of high gloss and smoothness can be produced without reducing bulk or thickness of the coating layer and that coated papers can be produced with high production efficiency. However, the gloss calendering method of the prior art is defective in that, although this method can produce high-gloss coated papers generally referred to as coated papers and art papers, it has been impossible for the method of the prior art to produce super-high-gloss coated papers.

Finishing methods of the prior art capable of producing super-high-gloss coated papers include a cast coating method wherein a coating layer which is substantially wet and is kept in a fluidized condition is brought into pressing contact with a finishing roll having a mirror-like surface to cast the mirror-like surface to the surface of the coating layer, and a brushing method in which the coating layer is finished by means of brushing. The cast coating method is defective in that a great deal of water has to be evaporated during finishing, and it is difficult to release the coating layer from the finishing roll, so that the production rate has to be extremely low. Also, since the moisture contained in the coating layer must move vigorously through the layer while the coating layer passes on the finishing roll, blisters tend to develop in the coating layer particularly in the case of two-side-coated papers. In order to avoid blisters, the coating speed must be further reduced, so that the coated papers produced become very expensive. The brushing method has the defect of being unable to produce coated papers of high smoothness. When this method is used for producing coated papers for printing use, the coated papers produced do not permit printing ink thereon to set quickly, so that the use of the coated papers produced by this method reduces printing efficiency.

SUMMARY OF THE INVENTION

An object of the present invention is to provide a method of finishing coated papers which enables to impart super-high-gloss to coated papers without deteriorating the advantages offered by the gloss calendering method of the prior art, and an apparatus suitable for carrying out the finishing method.

According to one aspect of the present invention, method of finishing a coated paper which is obtained by applying an aqueous coating composition containing thermoplastic synthetic resin emulsion to the surface of at least one side of a paper web to form a coating layer and then drying the coating layer at a temperature to maintain the coating layer below the glass transition temperature of the thermoplastic synthetic resin emulsion comprises a first finishing step of heating the surface of the coating layer to a temperature above the glass transition temperature of the emulsion by passing the coated paper web on a finishing roll while bringing the surface of the coating layer into pressing contact with a mirror-like metal surface of the finishing roll heated to a temperature above the glass transition temperature of the emulsion, a cooling step of reducing the temperature of the surface of the coating layer to a level not exceeding the glass transition temperature of the emulsion by 30° C., and a second finishing step of passing the coated paper web over one of the aforesaid finishing roll and another finishing roll having a mirror-like metal surface heated to a temperature above the glass transition temperature of the emulsion, while bringing the surface of the coating layer into pressing contact with the mirror-like metal surface of the one finishing roll.

According to another aspect of the invention, there is provided an apparatus for finishing a coated paper comprising a finishing roll having a mirror-like metal surface heated to a temperature above the glass transition temperature of thermoplastic synthetic resin emulsion, at least two pressing rolls located in positions adjacent to the circumferential surface of the finishing roll and spaced apart from each other in a circumferential direction of the finishing roll, each of the pressing rolls cooperating with the finishing roll to define therebetween a nip for a coated paper web to pass therethrough, guide roll means operative to guide the coated paper web in a manner to allow the same to successively pass through the nips defined between the finishing roll and the pressing rolls, and cooling means located adjacent to the path of travel of the coated paper web from one nip to the other nip.

Above and other objects, features and advantages of the invention will become more apparent from the description of preferred embodiments taken in conjunction with the accompanying drawings.

DESCRIPTION OF THE PREFERRED EMBODIMENTS

Figure 1:
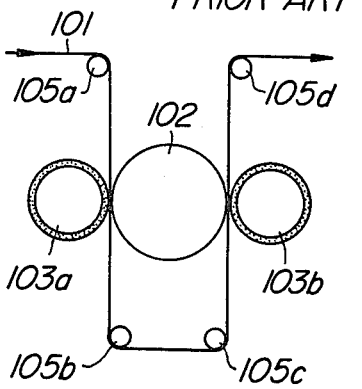
FIG. 1 PRIOR ART
FIG. 1 is a schematic view showing a gloss calender used in the gloss calendering method of the prior art.

Referring to FIG. 1, a gloss calendering apparatus suitable for practicing a gloss calendering method of the prior art comprises a finishing roll 102, and a pair of resilient pressing rolls 103*a* and 103*b*. In the gloss calendering method described, a coated paper web 101 obtained by applying an aqueous coating composition containing thermoplastic synthetic resin emulsion to the surface of at least one side of a paper web to form a coating layer or film and then drying the coating layer at a temperature below the glass transition temperature of the thermoplastic synthetic resin emulsion is introduced into a first nip defined between the finishing roll 102 and one pressing roll 103*a* in such a manner that the coated surface is brought into pressing contact with the surface of the finishing roll 102. The surface of the finishing roll 102 is a mirror-like metal surface which is heated to a temperature substantially higher than the glass transition temperature of the thermoplastic synthetic resin emulsion, so that the coating layer applied to the surface of the paper web is plasticized to its inner part adjacent to the paper web surface while the surface of the coating layer is being brought into pressing contact with the finishing roll 102. The coated paper web 101 is passed through a second nip between the finishing roll 102 and the other pressing roll 103*b* after passing through the first nip as described hereinabove. The numerals 105*a* to 105*d* in FIG. 1 designate guide rolls.

In the aforesaid gloss calendering method, the gloss value gain obtained by passing the coated web through the second calender nip is so small as 2–5% of the gloss value obtained after passing it through the first calender nip. It is hard to obtain a high gloss no matter what number of the calender nips the coated web is made to pass through. For example, the gloss value of a coated paper web after passing through four to six calender nips is increased by only about 10% as compared with that of the coated paper web after passing through the first of the four to six calender nips.

As the result of experiments conducted by the inventors, it has been found that significantly high level of gloss of the coated paper can be attained by leading the coated paper web into the first calender nip in a manner to bring the surface of the coating layer into pressing contact with the finishing roll, thereby plasticizing the coating layer as well as causing sufficient bonding among pigments and sufficient adhesion between the surface of a paper web and the coating layer, in turn cooling the coating layer so as to transfer the coating layer, preferably the entire coating layer, from a plasticized state to a solid state, and in turn bringing again the surface of the coating layer into pressing contact with the heated finishing roll. In the conventional gloss calendering method, the temperature of the surface of the coating layer drops by only less than 2° C. from the time the coated paper web leaves the first calender nip to the time it is introduced into the second calender nip. The inventors have found that it is possible to attain a significantly high level of gloss by lowering the temperature of the surface of the coating layer to a temperature below Tg plug 30° C., wherein Tg is the glass transition temperature of the thermoplastic synthetic resin emulsion. Preferably, the temperature of the surface of the coating layer is lowered to a temperature below Tg plus20° C., and more preferably to a temperature below Tg plus 10° C.

Although the reasons why the gloss value of the coating layer can be significantly increased by cooling the coating layer as aforesaid are not completely clear, it may be considered that, in the conventional gloss calendering method, the increase in gloss level is restrained since it is difficult to exert high frictional force on the surface of the coating layer while the coated paper web passes through the second calender nip. The coating layer is plasticized to its inner part by passing through the first calender nip as described hereinbefore, and the coating layer thus plasticized is led into and passes through the second calender nip while the plasticized state is maintained. For this reason, the high frictional force cannot be exerted on the coating layer surface as described above. According to the present invention, the coating layer plasticized to its inner part by passing through the first calender nip is subsequently cooled so that the coating layer may be hardened in its entirety or at least in its surface portion, and the coated paper web having the coating layer thus hardened is led into and passes through the second calender nip under condition that the hardened state of the coating layer is maintained. Consequently, high frictional force is exerted on the surface of the coating layer while the coated paper web is passing through the second calender nip, which significantly increases the gloss level of the coated paper.

The results of the experiments conducted by the inventors show that the cooling of the coating layer effected as described hereinabove results in an increase of 20 to 30% in the gloss value of the coating layer surface after passing through the second calender nip as compared with the gloss value thereof after passing through the first calender nip.

Figure 2:
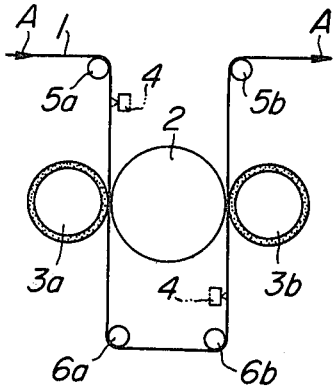
FIG. 2 is a schematic view of an apparatus for finishing coated papers according to an embodiment of the invention.

FIGS. 2 to 6 show embodiments of the finishing apparatus in accordance with the invention. FIG. 2 shows a first embodiment which comprises, like the gloss calendering apparatus shown in FIG. 1, a finishing roll 2, and a pair of resilient pressing rolls 3*a* and 3*b* arranged on the left and right sides of the finishing roll 2 adjacent to its circumferential surface and diametrically opposed to each other. The pressing rolls 3*a* and 3*b* cooperate with the finishing roll 2 to define first and second calender nips, respectively, for the coated paper web to pass therethrough. The gloss calendering apparatus also comprises rolls 5*a*, 5*b*, 6*a* and 6*b* for guiding the coated paper web 1 to allow the latter to successively pass through the first and second calender nips during its travel in the direction of an arrow A. The rolls 6*a* and 6*b* located along the path of travel of the coated paper web 1 from the first calender nip to the second calender nip also serve as cooling means or cooling rolls. The rolls 5*a* and 5*b* are designed to perform the function of guide rolls as aforesaid. However, the rolls 5*a* and 5*b* may be of the same construction as the rolls 6*a* and 6*b*.

The coated paper web 1 fed to the finishing apparatus shown in FIG. 2 has been obtained by applying an aqueous coating composition to the surface of at least one side of a paper web to form a coating layer or film and drying the coated surface or coating layer at a temperature below the glass transition temperature of the thermoplastic synthetic resin emulsion contained in the aqueous coating composition. The paper web is primarily formed of pulp and is suitable as a substrate of a coated paper web for printing. The aqueous coating composition comprises at least one coating pigment selected from the group consisting of kaolin, aluminum hydroxide, titanium oxide, calcium carbonate, satin white and plastic pigment, and a binder comprising thermoplastic synthetic resin emulsion. When necessary, the aqueous coating composition may further comprise a naturally occurring water-soluble high polymer selected from the group consisting of kasein, gelatin, starch and a denatured product of any one of these substances, or a synthetic water-soluble high polymer, such as polyvinyl alcohol and its denatured product. The aqueous coating composition may further comprise a thermosetting synthetic resin, such as melamine-formaldehyde resin, urea-formaldehyde resin, etc., and may also be added with a dispersing agent, a defoamer agent, a lubricating agent and/or a release agent. It is essential that the aqueous coating composition used in the present invention contains thermoplastic synthetic resin emulsion because the coating applied to the paper web has to be plasticized by being brought into pressing contact with the finishing roll after being dried. The amount of the thermoplastic synthetic resin emulsion contained in the coating composition is preferably 10 to 20 weight parts when the coating pigment is 100 weight parts.

The synthetic resin emulsion may be of any kind so long as it has a thermoplastic property. For example, the synthetic resin emulsion may be emulsion of any one of vinyl-base polymers such as polyvinyl acetate, ethylene-vinyl acetate copolymer; any one of acrylic acid-base polymers such as acrylic ester, a polymer or copolymer or methacrylate ester; or any one of diene polymers such as methyl methacrylate-butadiene copolymer.

Preferably, the synthetic resin emulsion has a glass transition temperature not less than 25° C., more preferably not less than 35° C. When the emulsion has a lower glass transition temperature, difficulties would be encountered in cooling and thus hardening at least the surface portion of the coating layer after the coating layer is heated to a temperature above the glass transition temperature of the emulsion in passing through the first calender nip.

The finishing roll 2 has a smooth mirror-like metal surface finished by grinding or plating, or by grinding or polishing after plating. Further, the finishing roll 2 is so constructed that the metal surface can be heated to a temperature above the glass transition temperature of the emulsion used. The temperature to which the metal surface of the finishing roll is heated may be varied depending on the glass transition temperature of the synthetic resin emulsion used. This temperature may be selected in the range between 50° and 200° C., preferably in the range between 100° and 180° C.

The coating layer of the coated paper web 1 heated by pressing contact with the finishing roll 2 in passing through the first calender nip is brought into contact with the cooling rolls 6*a* and 6*b*. Thus, the coating layer is cooled. The cooling is effected in such a manner that the temperature of the surface of the coating layer that has passed over the cooling rolls 6*a* and 6*b* is reduced to a temperature below $T_g$ plus 30° C., preferably below $T_g$ plus 20° C., and more preferably below $T_g$ plus 10° C., before being introduced into the second calender nip. It is to be noted that $T_g$ indicates the glass transition temperature of the thermoplastic synthetic resin emulsion. The cooling rolls 6*a* and 6*b* are of such construction that, for instance, cooling water is introduced into the interior of the rolls to cool the surface of the coating layer. The guide rolls and cooling rolls per se are of known construction and the desirable design of these rolls can be readily made by those skilled in the art.

In operation, the coated paper web 1 having the coating layer travels in the direction of the arrow A and first passes through the first calender nip between the finishing roll 2 and pressing roll 3*a*. At this time, the coated paper web 1 is forced by the pressing roll 3*a* against the finishing roll 2 such that the surface of the coating layer is brought into pressing contact with the heated metal surfaces of the finishing roll 2. Thus, the coating layer of the coated paper web 1 is heated and plasticized. Thereafter, the coating layer is brought into contact with the cooling rolls 6*a* and 6*b* to be cooled, so that at least the surface portion of the coating layer is hardened. The paper web 1 is in turn introduced into the second calender nip between the finishing roll 2 and pressing roll 3*b* where the coating layer is pressed by the pressing roll 3*b* against the finishing roll 2. The temperatures to which the coated paper web is heated and cooled as it passes through the first and second calender nips and cooling rolls are as described hereinabove.

Figure 3:
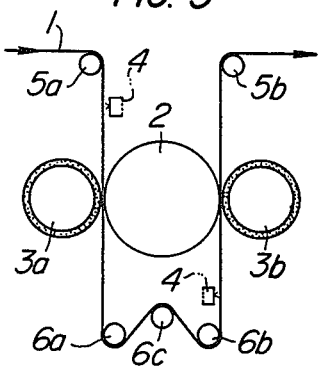
FIGS. 3–6 are schematic views of the apparatus for finishing coated papers according to second to fifth embodiments respectively, of the invention.
Figure 4:
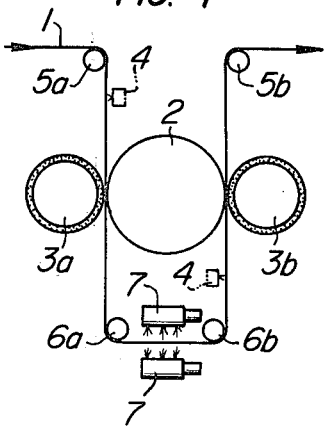
Figure 5:
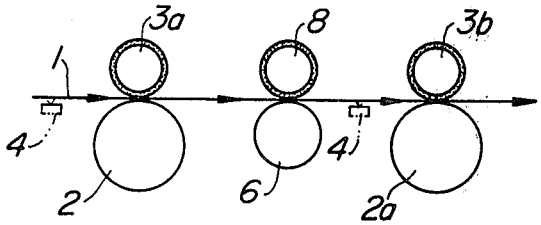

FIGS. 3 to 5 show second to fourth embodiments, respectively, wherein parts similar to those of the first embodiment shown in FIG. 2 are designated by like reference characters.

The second embodiment shown in FIG. 3 comprises an additional cooling roll 6*c* together with a pair of cooling rolls 6*a* and 6*b* disposed on the left and right sides, respectively, the cooling rolls 6*a* and 6*b* being substantially identical with the cooling rolls 6*a* and 6*b* of the first embodiment. Because of the provision of the additional cooling roll 6*c*, the cooling effects can be enhanced. The third embodiment shown in FIG. 4 is provided with blowing means 7 disposed in position between the pair of cooling rolls 6*a* and 6*b* and adjacent to the path of travel of the coated paper web 1. The blowing means 7 are arranged to blow cooling agent such as cooling air onto both sides of the coated paper web 1 so that the coated paper web 1 may be cooled from both sides, i.e., from the side on which the coating layer is applied as well as from the opposite side on which the coating layer is not applied. It is apparent that, by providing the blowing means 7, the cooling effects are advantageously enhanced. Other structures of the second and third embodiments are substantially identical with the structure of the first embodiment shown in FIG. 2.

In the third embodiment shown in FIG. 4, the cooling rolls 6*a* and 6*b* may be replaced by guide rolls which are constructed solely to guide movement or travel of the coated paper web 1, since the third embodiment includes blowing means 7 for effecting cooling of the coating layer. For the same reason, the cooling rolls 6*a* and 6*b* in the second embodiment shown in FIG. 3 may be replaced by such guide rolls. In the second embodiment, however, it is preferable that at least one of the rolls 6*a* and 6*b* are constructed as cooling rolls so as to effect reliable cooling. As similar to the first embodiment shown in FIG. 2, the coated paper web 1 passes over the rolls 6*a* and 6*b* with the surface of the coating layer contacted with the surface of the rolls 6*a* and 6*b*. On the other hand, the additional cooling roll 6*c* is arranged to contact the back surface of the coated paper web, i.e., the side of the paper web on which the coating is not applied. When both of the rolls 6*a* and 6*b* are replaced by the guide rolls, the cooling on the coating layer is effected only from the back surface of the paper web by means of the additional cooling roll 6c. Thus, there will be the case where sufficient cooling on the coating layer cannot be effected by only the additional cooling roll 6c.

In the fourth embodiment shown in FIG. 5, two finishing rolls 2 and 2a are provided and the pressing rolls 3a and 3b are each disposed in juxtaposed relation with one of the finishing rolls 2 and 2a. A cooling roll 6 cooperating with a resilient pressing roll 8 is located midway between the finishing rolls 2 and 2a. The coated paper web 1 passes through the first calender nip between the finishing roll 2 and pressing roll 3a with the coating layer contacting the finishing roll 2, in turn is cooled by the cooling roll 6, and in turn passes through the second calender nip between the finishing roll 2a and pressing roll 3b with the coating layer contacting the finishing roll 2a. It will be understood that the coated paper web 1 passes between the cooling roll 6 and the pressing roll 8 with the coating layer contacting the cooling roll 6, so that the coated paper web 1 is cooled from the side on which the coating layer is applied.

The first to fourth embodiments have been shown and described as having the coated paper web 1 passing through the first and second calender nips only. It is however to be understood that by providing the finishing rolls and pressing rolls in suitable numbers, it is possible to make the coated paper web 1 pass through a plurality of calender nips before it is introduced into the first calender nip and/or after it has passed through the second calender nip.

Figure 6:
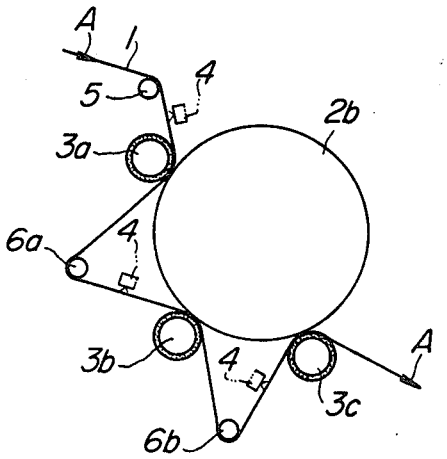

FIG. 6 shows a fifth embodiment of the finishing apparatus in accordance with the invention, wherein three pressing rolls 3a, 3b and 3c are arranged in positions along the circumferential surface of a finishing roll 2b having large diameter and circumferentially spaced apart from one another. The pressing rolls 3a, 3b and 3c are disposed in upstream, midstream and downstream positions, respectively, as viewed in the direction of travel of the coated paper web 1, and first to third calender nips are defined between the finishing roll 2a and pressing rolls 3a to 3c respectively. Cooling rolls 6a and 6b are located between the pressing rolls 3a and 3b and between the pressing rolls 3b and 3c respectively in positions in which the cooling rolls 6a and 6b are spaced apart from the circumferential surface of the finishing roll 2b. Thus the coated paper web 1 moves along a zigzag path of travel in such a manner that the coated paper web 1 is brought into and out of contact with the finishing roll 2b in plural times. More specifically, the coated paper web 1 is brought into contact with the cooling roll 6a to be cooled after passage through the first calender nip, passed through the second calender nip between the finishing roll 2b and pressing roll 3b, brought into contact with the cooling roll 6b to be cooled after leaving the second calender nip, and finally passed through the third calender nip between the finishing roll 2b and pressing roll 3c. In FIG. 5, numeral 5 designates a guide roll.

It is to be understood that the finishing apparatus according to the invention may, of course, be provided with known moistening means designated by reference numeral 4 in FIGS. 2 to 6. The moistening means 4 are located in position along the path of travel of the coated paper web 1 and on the upstream sides of the respective calender nips, so as to moisten the coating layer of the coated paper web 1 before the coated paper web 1 is introduced into the respective calender nips. More particularly, in FIGS. 2 to 4, the moistening means 4 are arranged on the upstream of the first calender nip or in position between the guide roll 5a and the first calender nip, and on the upstream of the second calender nip or in position between the cooling roll 6b and the second calender nip. In FIG. 5, the moistening means 4 are arranged on the upstream of the first calender nip, and between the cooling roll 6 and the second calender nip. Further, in FIG. 6, the moistening means 4 are arranged on the upstream of the first calender nip, between the cooling roll 6a and the pressing roll 3b, and between the cooling roll 6b and the pressing roll 3c.

In the illustrated embodiments shown and described hereinabove, the cooling rolls 6, 6a and 6b are arranged in such a manner that the surface of the coating layer is brought into contact therewith. However, the invention is not limited to this specific arrangement, and the cooling rolls may be brought into contact with that surface of the coated paper web 1 opposite to the coated surface thereof, so as to cool and harden the coating layer through the substrate of the coated paper web 1. It will be apparent that in this case hardening of the coating layer commences at a portion thereof which is adjacent the substrate of the coated paper web 1. It will be understood from the previous description that, preferably, the cooling is effected from that side of the coated paper web 1 on which the coating is applied, or from both sides of the coated paper web 1.

EXAMPLE 1

Experiments were conducted to ascertain the meritorious effects obtained by the invention. In the experiments, an internally sized paper web was undercoated on one side with a coating comprising 100 weight parts of kaolin and 20 weight parts of oxidized starch in an amount of 5 g/m$^2$ in bone dry condition. After drying, another aqueous coating was applied to the surface of the under-coating in an amount of 15 g/m$^2$ in bone dry condition, and the coated web was dried under a condition to maintain the coating layer temperature to approximately 35° C. until its moisture content has become 6%. The composition of the aforesaid another aqueous coating was as follows:

| | Parts by weight |
|---|---|
| Kaolin | 100 |
| Tetrasodium pyrophosphate (dispersant) | 0.15 |
| Polyvinyl acetate emulsion (glass transition temperature: 49° C.) | 20 |

Finishing of the coated paper web prepared by the aforesaid process was effected by the conventional method using the apparatus shown in FIG. 1, and by the method of the invention using the apparatus shown in FIGS. 2 and 5. The results obtained are shown in Table 1. In carrying out the finishing operation, the finishing rolls 102, 2 and 2a shown in FIGS. 1, 2 and 5 were heated so that the surface temperature was kept at 130° C., and the nip pressure between the finishing roll or rolls and the pressing rolls cooperating therewith was adjusted to 120 kg/cm. The samples 1 to 4 shown in the Table 1 refer to the following:

(a) Sample 1. In obtaining this sample, the apparatus shown in FIG. 2 was used and finishing was effected in such a manner that the surface of the coating layer of the coated paper web which has passed through the first calender nip is cooled by the cooling rolls 6a and 6b to a temperature of 69° C., before the paper web is fed into the second calender nip.

(b) Sample 2. In obtaining this sample, the apparatus shown in FIG. 5 was used, and the temperature of the surface of the coating layer was reduced to 49° C. by the cooling roll 6.

(c) Sample 3. In obtaining this sample, the apparatus shown in FIG. 5 was used, and the temperature of the surface of the coating layer was reduced to 69° C. by the cooling roll 6.

(d) Sample 4. In obtaining this sample, finishing was effected by using the apparatus of the prior art shown in FIG. 1.

TABLE 1

| Item Sample | 1 | 2 | 3 | 4 |
|---|---|---|---|---|
| Gloss Reading at 75° | 63 | 73 | 68 | 45 |
| Gloss Reading at 60° | 34 | 45 | 42 | 21 |
| Smoothness Reading (mm Hg) | 16 | 7 | 12 | 25 |

The readings given in the table was determined by the following tests:

Gloss Reading at 75° . . . TAPPI-T-480.

Gloss Reading at 60° . . . JIS Z-8741.

Smoothness Reading by Smoothter . . . Model SM-6A of "Smoothter" tester made by Toei Denshi Kogyo K.K., Japan, was used.

Table 1 shows that samples 1 to 3 finished by the method according to the invention is superior in the gloss readings and in smoothness to sample 4 finished by the method of the prior art, and that sample 2, in particular, shows excellent results.

EXAMPLE 2

In this example, the apparatus shown in FIG. 4 was used, and the cooling of the coating layer surface of the coated paper web was effected by the cooling rolls 6a and 6b and the blowing means 7 after it left the first calender nip and before entering into the second calender nip. Cooling condition were varied by adjusting the cooling rolls 6a and 6b and blowing means 7 to give different cooling effects or levels. The results obtained in this example are shown in Table 2. The coated paper web used in example 2 was prepared in the same manner as the coated paper web used in example 1. The temperature of the surface of the finishing roll 2 was adjusted to 130° C. and the nip pressure between the finishing roll 2 and pressing rolls 3a and 3b was adjusted to 120 kg/cm as was the case of example 1. Also, the gloss reading at 75°, gloss reading at 60° and smoothness reading by Smoothter were measured in the same manner as in example 1.

TABLE 2

| Item Sample | $T_1$ (°C.) | $T_1 - T_g$ (°C.) | $T_2 - T_1$ (°C.) | Gloss Reading at 75° | Gloss Reading at 60° | Smoothness Reading (mm Hg) |
|---|---|---|---|---|---|---|
| 1 | 39 | −10 | 91 | 73 | — | — |
| 2 | 49 | 0 | 81 | 73 | 45 | 7 |
| 3 | 59 | +10 | 71 | 72 | — | — |
| 4 | 69 | +20 | 61 | 63 | 34 | 16 |
| 5 | 74 | +25 | 56 | 52 | — | — |
| 6 | 79 | +30 | 51 | 48 | — | — |
| 7 | 89 | +40 | 41 | 47 | — | — |
| 8 | 129 | +80 | 1 | 45 | 21 | 25 |

In Table 2, $T_1$, $T_g$ and $T_2$ denote the coating layer surface temperature that is read after being cooled by the cooling rolls 6a and 6b and the blowing means 7 but before being fed into the second calender nip, the glass transition temperature (i.e., 49° C.) of polyvinyl acetate emulsion and the temperature (i.e., 130° C.) of the surface of finishing roll 2, respectively. Sample 8 is the one finished by means of the prior art apparatus shown in FIG. 1.

Figure 7:
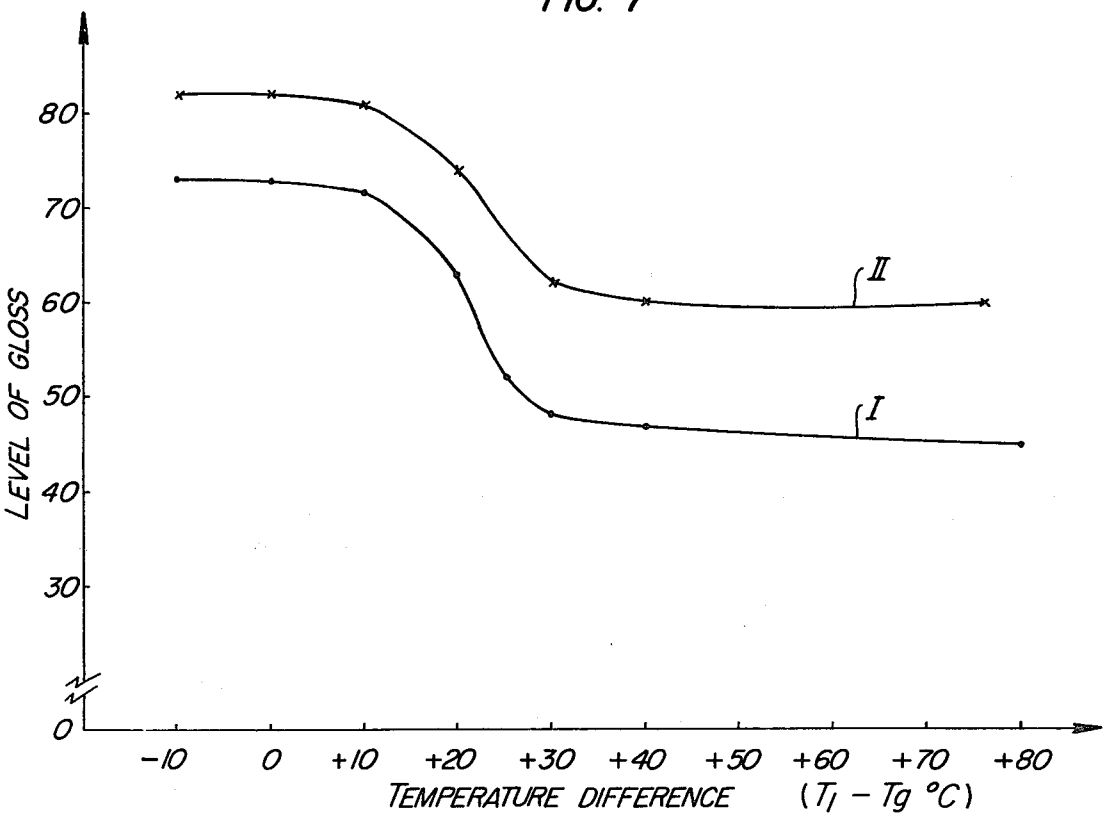
FIG. 7 is a diagrammatic representation of the meritorious effects achieved by a method of finishing coated papers according to the invention.

FIG. 7 diagrammatically shows the gloss reading at 75° C. as a function of the temperature difference, $T_1 - T_g$ (° C.), wherein curve I was drawn based on the relevant data of Table 2. Curve I shows a market or noticeable rise in 75° gloss reading as $T_1 - T_g$ (° C.) reduces to about 30° C., i.e., as the coating layer surface temperature ($T_1$) drops to a temperature level below $T_g$ plus 30° C. as the result of cooling by means of the cooling rolls 6a, 6b and the blowing means 7. It is also to be noted that the 75° gloss reading shows a sharp rise when $T_1 - T_g$ is brought substantially into the range, 25° C. to 20° C., and that the rise in 75° gloss reading becomes slow and gradual after $T_1 - T_g$ is brought to less than 20° C. This indicates that if cooling of the coating layer is effected by the cooling rolls 6a and 6b and the blowing means 7 in such a manner that $T_1 - T_g$ becomes 20° C. or less, it is possible to raise the level of gloss of the coated paper considerably. When $T_1 - T_g$ becomes about 10° C., the gloss reading nearly reaches the upper limit and levels off after $T_1 - T_g$ is lowered than 10° C. When $T_1 - T_g$ reaches 0° C., the gloss reading is almost maximized and a further reduction in $T_1 - T_g$ causes no substantial change in gloss reading. Thus it has been ascertained that particularly advantageous results can be achieved by cooling the coating layer in such a manner that $T_1 - T_g$ becomes below 10° C.

In example 2, no detailed examination was made on the gloss reading at 60° and the smoothness reading. However, it is assumed that the gloss readings at 60° will show similar tendency as those of the gloss readings at 75°. Concerning the smoothness reading, it is not completely clear whether its characteristic curve follows a pattern similar to curve I in FIG. 7. However, it can be seen in Table 2 that the smoothness was considerably improved when $T_1 - T_g$ was 20° C. and was further improved when $T_1 - T_g$ was 0° C.

EXAMPLE 3

In this example, the following aqueous coating composition was used to prepare a coated paper web in the same manner as described with reference to example 1.

| | Parts by Weight |
|---|---|
| Kaolin | 100 |
| Tetrasodium pyrophosphate (dispersant) | 0.15 |
| Acrylic polymer emulsion ($T_g$, 103° C.) | 20 |

The coated paper web was finished by using the finishing apparatus shown in FIG. 4. Cooling conditions were varied by adjusting the cooling rolls 6a and 6b and the blowing means 7 to give different cooling effects or levels. The results are shown in Table 3. In effecting finishing, the temperature of the surface of the finishing roll 2 was adjusted to 180° C., and the nip pressure between the finishing roll 2 and pressing rolls 3a and 3b was adjusted to 120 kg/cm.

TABLE 3

| Item Sample | $T_1$ (°C.) | $T_1 - T_g$ (°C.) | $T_2 - T_1$ (°C.) | Gloss Reading of White Paper at 75° |
|---|---|---|---|---|
| 1 | 93 | −10 | 87 | 82 |
| 2 | 103 | ±0 | 77 | 82 |
| 3 | 113 | +10 | 67 | 81 |
| 4 | 123 | +20 | 57 | 74 |
| 5 | 133 | +30 | 47 | 62 |
| 6 | 143 | +40 | 37 | 60 |
| 7 | 179 | +76 | 1 | 60 |

In Table 3, $T_1$ and $T_2$ represent the same items as described by referring to Table 2, and $T_g$ represents the glass transition temperature (103° C.) of acrylic polymer emulsion. The level of gloss at 75° was determined by the same process as described with reference to example 2. Sample 7 in Table 3 was the one finished with the use of the prior art apparatus shown in FIG. 1.

Curve II in FIG. 7, was drawn based on the data of Table 3. The curve II shows the same characteristics as curve I. It is seen that when $T_1 - T_g$ is in the vicinity of 30° C. the level of gloss shows a marked or noticeable increase, that the level of gloss considerably rises when $T_1 - T_g$ is in the vicinity of 20° C., and that the gloss reading is near its upper limit when $T_1 - T_g$ is about 10° C.

What is claimed is:

1. A method of finishing a coated paper web which is obtained by applying an aqueous coating composition containing thermoplastic synthetic resin emulsion to the surface of at least one side of a paper web to form a coating layer and drying the coating layer at a temperature to maintain said coating layer below the glass transition temperature of the thermoplastic synthetic resin emulsion, comprising:

a first finishing step of heating the surface of the coating layer of the coated paper web to a temperature above the glass transition temperature of the emulsion by passing the coated paper web on a finishing roll while bringing the surface of the coating layer into pressing contact with a mirror-like metal surface of the finishing roll heated to a temperature above the glass transition temperature of the emulsion;

a cooling step of reducing the temperature of the surface of the coating layer to a level not exceeding the glass transition temperature of the emulsion by 30° C.; and a second finishing step of passing the coated paper web on one of said finishing roll and another finishing roll having a mirror-like metal surface heated to a temperature above the glass transition temperature of the emulsion, while bringing the surface of the coating layer into pressing contact with the mirror-like metal surface of said one finishing roll.

2. A finishing method as claimed in claim 1, wherein the temperature of the surface of the coating layer of the coated paper web is reduced to a level not exceeding the glass transition temperature of the emulsion by 20° C. in said cooling step.

3. A finishing method as claimed in claim 1, wherein the temperature of the surface of the coating layer of the coated paper web is reduced to a level not exceeding the glass transition temperature of the emulsion by 10° C. in said cooling step.

4. A finishing method as claimed in claim 1, 2 or 3, wherein said cooling of the surface of the coating layer is effected from the side of the coated paper web on which the coating layer to be cooled is formed.

5. A finishing method as claimed in claim 1, 2 or 3, wherein said cooling of the surface of the coating layer is effected both from the side of the coated paper web on which the coating layer to be cooled is formed and from the side opposite thereto.

6. A finishing method as claimed in claim 1, 2 or 3, wherein the amount of the thermoplastic synthetic resin emulsion contained in the aqueous coating composition is 10 to 20 parts per 100 parts coating pigment by weight.

7. A finishing method as claimed in claim 1, 2 or 3, wherein the surface of the finishing roll is heated to 100° to 180° C. in the first finishing step and the second finishing step.

8. A finishing method as claimed in claim 1, 2 or 3, wherein the surface of the coating layer is cooled in said cooling step by passing the coated paper web over at least one cooling roll in a manner to bring the surface of the coating layer into pressing contact with said cooling roll.

9. A finishing method as claimed in claim 1, 2 or 3, wherein said cooling of the surface of the coating layer is effected by blowing onto the latter surface a cooling agent in said cooling step.

10. An apparatus for finishing coated papers comprising:

a finishing roll having a mirror-like metal surface heated to a temperature above the glass transition temperature of thermoplastic synthetic resin emulsion;

at least two pressing rolls located in positions adajacent to the circumferential surface of said finishing roll and spaced apart from each other in a circumferential direction of said finishing roll, each of said pressing rolls cooperating with said finishing roll to define therebetween a nip for a coated paper web to pass therethrough;

guide roll means operative to guide said coated paper web in a manner to allow the same to successively pass through the nips defined between said finishing roll and said pressing rolls; and cooling means located adjacent to the path of travel of said coated paper web from one nip to the other nip.

11. A finishing apparatus as claimed in claim 10, wherein said pressing rolls are two in number and located in positions along the circumferential surface of said finishing roll diametrically opposed to each other.

12. A finishing apparatus as claimed in claim 10, wherein said pressing rolls are three in number and located in positions along the circumferential surface of said finishing roll to define a first nip, a second nip and a third nip in an upstream position, a midstream position and downstream position, respectively, along the path of travel of said coated paper web, and wherein said cooling means comprises a first cooling device located adjacent to the path of travel of said coated paper web from said first nip to said second nip and a second cooling device located adjacent to the path of travel of said coated paper web from said second nip to said third nip.

13. An apparatus for finishing coated papers, comprising:

at least two finishing rolls each having a mirror-like metal surface heated to a temperature above the glass transition temperature of thermoplastic synthetic resin emulsion;

at least two pressing rolls each arranged adjacent to each of said finishing rolls;

means for guiding a coated paper web to allow the same to pass through at least two nips defined between said at least two finishing rolls and said at least two pressing rolls; and cooling means located adjacent the path of travel of said coated paper web between said at least two nips.

14. A finishing apparatus as claimed in claim 10, 11, 12 or 13, further comprising moistening means located adjacent the path of travel of the coated paper web and each arranged near the inlet end of one of said nips.

15. A finishing apparatus as claimed in claim 10 or 13, wherein said cooling means comprises at least one cooling roll over which the coated paper web passes.

16. A finishing apparatus as claimed in claim 10 or 13, wherein said cooling means comprises a cooling agent blowing means.

* * * * *